US006042978A

United States Patent [19]

Soeda et al.

[11] Patent Number: 6,042,978

[45] Date of Patent: Mar. 28, 2000

[54] IMAGE-FORMING METHOD

[75] Inventors: Kaori Soeda; Yoshiaki Kobayashi; Meizo Shirose; Hiroshi Yamazaki, all of Hachioji, Japan

[73] Assignee: Konica Corporation, Japan

[21] Appl. No.: 09/102,304

[22] Filed: Jun. 24, 1998

[30] Foreign Application Priority Data

Jun. 26, 1997 [JP] Japan ..... 9-170443
Jun. 26, 1997 [JP] Japan ..... 9-170444

[51] Int. Cl.[7] ..... G03G 13/01; G03G 9/08

[52] U.S. Cl. ..... 430/45; 430/106; 430/126

[58] Field of Search ..... 430/45, 47, 110, 430/137, 106, 126

[56] References Cited

U.S. PATENT DOCUMENTS 5,660,959 8/1997 Moriyama et al. ..... 430/45
5,766,816 6/1998 Nagase et al. ..... 430/124
5,853,938 12/1998 Nakazawa et al. ..... 430/137

*Primary Examiner*—John Goodrow
*Attorney, Agent, or Firm*—Jordan B. Bierman; Bierman, Muserlian and Lucas

[57] ABSTRACT

An image-forming method is disclosed. A plurality of colored toner images, different in color, are successively transferred onto a recording material wherein the transferred images are simultaneously subjected to one time fixing, and one of the toners comprises a binder and C. I. Solvent Yellow 93 or C.I. Solvent Yellow 162, both which are yellow colorants.

10 Claims, 2 Drawing Sheets

IMAGE-FORMING METHOD

FIELD OF THE INVENTION

The present invention relates to an image-forming method for electrophotographic color copiers and color printers.

BACKGROUND OF THE INVENTION

Conventionally, various color image-forming methods employing electrophotographic processes have been known.

In the color image-forming method, it is required that the spectral reflection characteristics of a toner approach the ideal values; when toners are superimposed to form an image on a support, no upper layer toner shields the lower layer toner, and when an image formed on a transparent sheet (hereinafter referred to as OHT) for an overhead projector, the toner layer results in minimum light scattering and no variation in hue is caused.

Colorants employed for colored toners include pigments such as C. I. Pigment Yellow 12, C. I. Pigment Yellow 17, C. I. Pigment Yellow 185, etc. However, the transparency of the toner layer is degraded because these pigments are dispersed into a toner in the state of secondary aggregates of not less than 0.1 $\mu$m.

In order to improve dispersibility, a method has been known in which a master-batch is prepared by, in advance, dispersing a high concentration pigment into a resin and employing such as the colorant. However, because the size of the primary particles of the pigment is not less than 0.1 $\mu$m, it is impossible to disperse the pigment into particles smaller than that. On account of this, when an image is formed by superimposing two or more toners, the upper layer is inferior in toner transparency to result in shielding of the toner in the lower layer and a resulting decrease in the chroma. Furthermore, in the case of forming an image on an OHT, when a pigment is employed as a colorant, a decrease in the transparency and deterioration of the color reproduction are caused due to the above reasons.

SUMMARY OF THE INVENTION

In an image-forming method, in which a plurality of image-forming devices provided with a development means forming a toner image by developing a latent image formed on an latent image holding body employing a developer contained in a developer-containing member, are arranged along a conveyance belt, and a recording material is conveyed by the conveyance belt and passed through the image-forming device, to provide in superimposed images, an image-forming method which forms an OHT image exhibiting excellent color reproduction and transparency through an increase in chroma by preventing shielding of a lower layer by improving the transparency of the toner in an upper layer.

The image-forming method of the present invention is now described.

An image-forming method in which a plurality of colored toner images, different in color, are successively transferred onto a recording material; the transferred images are simultaneously subjected to one time fixing, and one of the toners comprises C. I. Solvent Yellow 93 or C.I. Solvent Yellow 162, both which are yellow colorants.

DETAILED DESCRIPTION OF THE INVENTION

Figure 1:
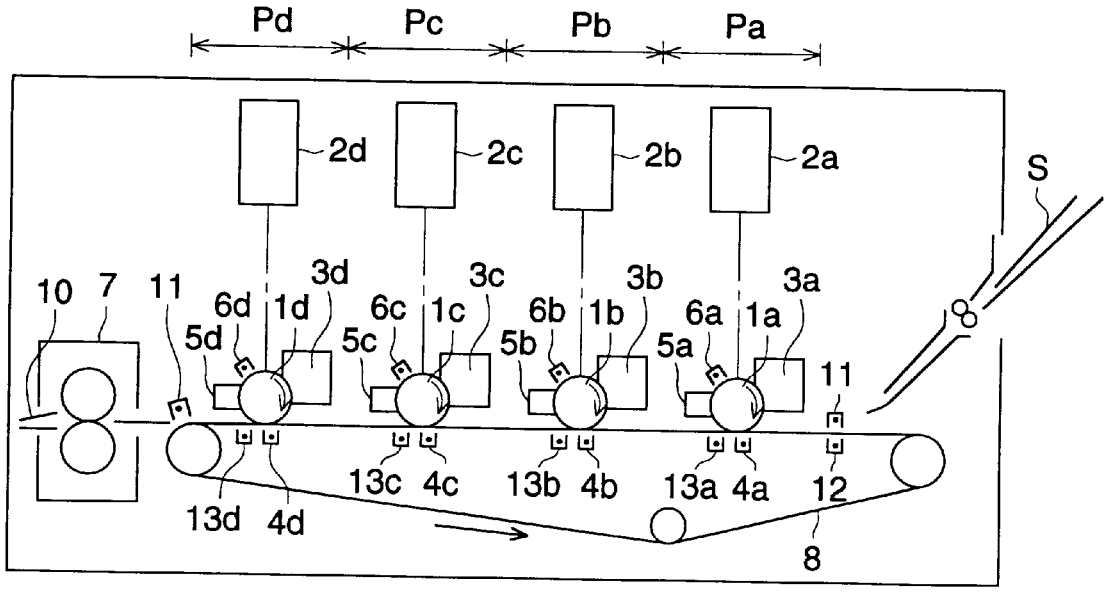
FIG. 1 shows a model image forming apparatus employed in the image forming method of the invention.

When a pigment is employed as a colorant, in most cases, due to inferior toner transparency, shielding a lower layer superimposed on an image supporting material and scattering incident light on the OHT are caused and result in degradation of image quality.

When C. I. Solvent Yellow 93 or C.I. Solvent Yellow 162 of the present invention is employed, the toner transparency is improved, which minimizes the problems above-mentioned.

Though the reasons for exhibiting the advantages of the present invention are not well clarified, it is considered that C. I. Solvent Yellow 93 and C. I. Solvent Yellow 162 are dissolved in a resin under a molecular state or are dispersed forming very small particles (0.1 $\mu$m or less). Thus, the diameter of the dispersed particles is less than wavelengths of visible light and light incident on an image formed on a support may not be scattered.

In the present invention, either the C. I. Solvent Yellow 93 or the C. I. Solvent Yellow 162 is employed as a colorant. The added amount of toner is between 0.01 and 15 weight parts, and preferably between 1.0 and 10 weight parts of the binder resin.

Any type of binders, generally employed, are acceptable. Included, for example, are styrene resins, acrylic resins, styrene-acrylic resins, polyester resins, epoxy resins, and the like.

Other additives are optionally employed, if desired. For example, release agents specifically include olefins such as low molecular weight polypropylene, low molecular weight polyethylene, ethylene-propylene copolymers, etc., microcrystalline wax, carnauba wax, paraffin wax, etc.

Charge control agents are preferably colorless in terms of color forming properties. For example, those having a quaternary ammonium salt structure and a carixallene structure are illustrated.

As external additives added after colored toner particles are prepared, fine inorganic particles and fine organic particles can be externally added for the purpose of improving toner fluidity, controlling the charge amount, etc. Fine silica particles and fine titania particles are preferably employed in which the surface is subjected to treatment with a coupling agent having an alkyl group. Further, the number average primary particle diameter of these is preferably between 10 and 500 nm. Still further, the added amount to a toner is preferably between 0.1 and 10 weight percent.

In many cases, these toners are usually employed in the form of a two-component developer in order to obtain consistent color images. As carriers employed in such case, may be either a non-coated carrier composed only of magnetic material particles such as iron, ferrite, etc., or a resin-coated carrier prepared by coating the surface of magnetic material particles with a resin, etc.

The average particle diameter of the carrier is preferably between 15 and 150 $\mu$m, preferably 30 and 150 $\mu$m in terms of the volume average particle diameter.

An image-forming method is employed in which an image-forming section (image-forming device) of four separate color developers is provided; in each separate image-forming section, a visible image of each color is formed on a photosensitive drum employed as an image-holding body;

these visible images are successively transferred to a recording material supplied from the exterior and are simultaneously fixed to obtain a full color image.

With reference to FIG. 1, one example of an image-forming method is described in which a plurality of color images are formed in an image-forming section and these images are successively transferred and superimposed to the same recording material.

In a color electrophotographic apparatus utilizing a multicolor electrophotographic system to obtain color images, an image-forming method is employed in which a plurality of image-forming devices are provided; visible color images (toner images) of different colors are formed employing the image-forming devices, and the resulting toner images are successively transferred and superimposed onto the same recording material.

The above-mentioned image-forming method is constituted, for example, as shown in FIG. 1. A first, second, third, and fourth image forming section, Pa, Pb, Pc, and Pd are arranged and each of the image-forming sections is equipped with a special image carrying body, a so-called photosensitive drum, 1*a,* 1*b,* 1*c,* and 1*d.*

Along the circumference of each of the photosensitive drums 1*a,* 1*b,* 1*c,* and 1*d,* exposure sections 2*a,* 2*b,* 2*c,* and 2*d;* development sections 3*a,* 3*b,* 3*c,* and 3*d;* transfer discharge sections 4*a,* 4*b,* 4*c,* and 4*d,* and cleaning sections 5*a,* 5*b,* 5*c,* and 5*d* are provided.

Firstly, a latent image corresponding to, for example, the yellow component in the original is formed on the photosensitive drum la in the first image-forming section employing the exposure section 2*a;* the resulting latent image is visualized by the developer comprising a yellow toner in the development section 3*a,* and is transferred onto a recording material in the transfer discharge section 4*a.*

In the second image-forming section Pb, a latent image corresponding to the magenta component is formed on the photosensitive drum 1*b* and is visualized by the developer comprised of a magenta toner. The resulting visualized image (magenta toner image) is transferred and superimposed onto predetermined positions of the recording material S, onto the yellow toner image is transferred in the above-mentioned first image-forming section, when the recording material S is conveyed into the transfer discharge section 4*b.*

Subsequently, in the same method as mentioned above, a cyan image and a black image are formed employing the third and the fourth image-forming section Pc and Pd, respectively, and the cyan image and the black image are transferred onto the same recording material, and superimposed which will result in a full color image. After such image-forming processes, the recording material S is conveyed to a fixing device 7, where the toner images on the recording material are fixed. Thus, a multicolor image is obtained on the recording material S. Each of the photosensitive drums 1*a,* 1*b,* 1*c* and 1*d* after transfer is finished is subjected to removal of the residual toner employing each of cleaning sections 5*a,* 5*b,* 5*c,* and 5*d* and is utilized to form a forthcoming latent image.

In the above-mentioned image-forming apparatus, in order to convey the recording material S, a conveyance belt 8 is employed. In FIG. 1, the recording material S on the belt is conveyed from the right side to the left side, and during the conveying process, the recording material S passes through each of the image-forming sections Pa, Pb, PC and Pd and the transfer discharge sections 4*a,* 4*b,* 4*c,* and 4*d,* and toner images are transferred onto the recording material S.

In this image-forming method, as the conveying means to convey a recording material, from the view point of the ease of machining and the durability, conveyance belts are utilized which employ a polyester fiber mesh or a thin dielectric sheet comprised of polyethylene terephthalate series resins, polyimide series resins, urethane series resins, etc.

When the recording material S passes through the fourth image-forming section Pd, AC voltage is applied to a charge-removing device and the recording material S is subjected to charge removal and subsequent separation, and enters into the fixing device 7, in which it is fixed and ejected from an ejection outlet 10.

In FIG. 1, numerals 11 and 12 are adhesion charging devices, and 13*a,* 13*b,* 13*c,* and 13*d* are separation charge removing discharging.

In this image-forming method, it may be constituted in such a way that each of independent image carrying bodies 1*a,* 1*b,* 1*c,* and 1*d* is equipped in the image-forming section and a recording material is successively conveyed to the transfer section of each of the image carrying bodies employing a belt-type conveying means.

Figure 2:
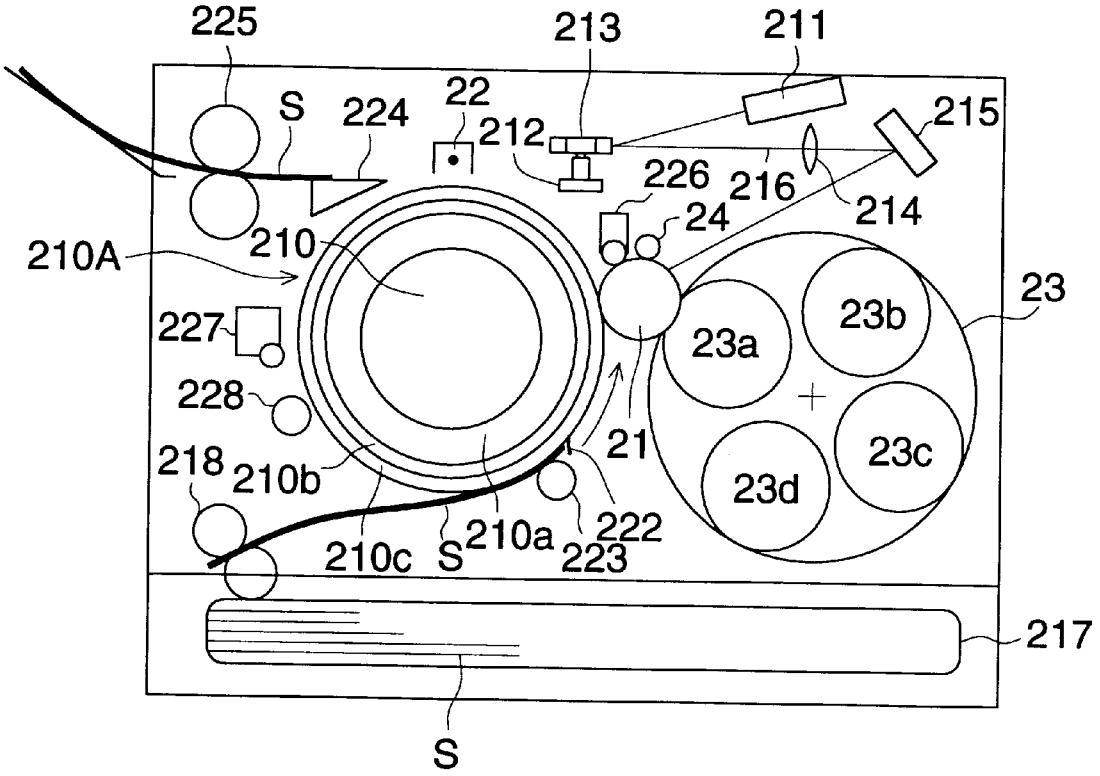
FIG. 2 shows another model image forming apparatus employed in the image forming method of the invention.

With reference to FIG. 2, another example of the image-forming method employed in the present invention is explained.

A latent image formed on a latent image carrying body 21 is developed by a development device 23*a* comprising a first color toner, and the resulting image is transferred onto a recording material S carried by a transfer drum 210. In the same manner, different color images formed by development devices 23*b,* 23*c,* and 23*d* are successively transferred onto the recording material. The recording material carrying the formed color toner images is separated from the transfer drum employing a separation claw 224 and is fixed by a fixing device 225.

In the present apparatus, a latent image carrying body (photoreceptor) 21 is provided, and mounted around the latent image carrying body with a charging device composed of a charging roller; a rotary development device 23 consisting of a plurality of development devices; a transfer device 210A, and a cleaning device 226. Furthermore, above the latent image carrying body 21, there is arranged a laser diode constituting an exposure device, a polygon mirror 213 rotated by a high speed motor 212, a lens 214, and a reflecting mirror 215, and scanning exposure light 216 is formed employing the above-mentioned devices.

The latent image carrying body (photoreceptor) 21 comprises, on the circumference of a rigid metal body composed of, for example, aluminum, etc., a photoconductor composed of, for example, an organic photosensitive compound (OPC). The photoconductors may be amorphous silicone, CdS, Se, etc.

Transfer device 210A is equipped with an electrically conductive elastic layer 210*b,* a dielectric high-resistance layer 210*c* and a transfer drum 210, and around the transfer drum, there are arranged an adhesion roller 223, a charge-removing charging device 22, a separation claw 224, a cleaning device 227 and a charge-removing roller 228. The transfer drum comprises a gripper 222 as a recording material holding member at one point on the circumference.

On the other hand, a recording material (transfer sheet) is supplied to the transfer drum 210 in the transfer device 210A from the interior of a recording material cassette 217 by pick-up rollers 218, in synchronization with the image on the photoreceptor 21. The transfer drum holds the supplied recording material with the gripper 22 and conveys the material to the image-forming section facing the photoreceptor. The recording material conveyed to the image transfer section is brought into contact with the photoreceptor, and each of color images on the photoreceptor is transferred onto the recording material by a constant contact transfer pressure between the transfer drum 210 and the photoreceptor and applied transfer voltage.

At that time, recording material S is charged by the transfer voltage at the same time of transfer and the recording material is electrostatically adhered and secured onto the surface of the transfer drum. In order to promote the electrostatic adhesion of the recording material, the above-mentioned adhesion roller 223 is arranged near the supply section of the recording material to the transfer drum, and by applying the voltage for adhesion to the roller, the recording material is frequently subjected to previous electrostatic adhesion after being held by the gripper 22. This operation is repeated employing the development device containing different color toners to form a color image on the recording material.

The recording material, onto which four color toner images have been transferred, is then subjected to charge removal employing the charge-removing charging device 25. Thereafter, the material is separated from the transfer drum by the separation claw 224 arranged in the following operation flow and transported to the fixing device 225. In the fixing device, four color toner images are fixed by heat and pressure and color mixing of toner images and fixing onto the recording material are carried out. After rendering the full color image long-term durability, the resulting material is ejected out from the image-forming apparatus. Preferably, the transfer drum subjected to separation of a recording material is subjected to removal of any remaining toner on its surface, employing a cleaning device 227 equipped with cleaning members such as a fur brush, a web, etc.

Furthermore, at almost the same time when the recording material is separated from the transfer drum by employing the separation claw, the charge-removing roller 28 is brought into contact with the transfer drum and the charge on the surface of the transfer drum is removed by the action of the AC bias, (or DC bias superimposed on it) applied to the charge-removing roller.

This image-forming method comprises a member brought into pressure contact with a latent image holding body in at least one process of a charging process, a transfer process, and a cleaning process.

Examples of the member subjected to the pressure contact include a charging roller, a charging blade, an electrically conductive brush, etc. in the case of contact charging; a transfer roller, a transfer belt, a transfer drum, etc. in the case of contact transfer; blade cleaning, magnetic brush cleaning, fur brush cleaning, roller cleaning, etc. in the case of cleaning.

EXAMPLES

The present invention is explained in detail with reference to Examples. Further, parts herein are by weight, unless otherwise specified.

Example 1

A mixture consisting of 100 parts of a polyester resin, 3 parts of low molecular weight polypropylene and each colorant mentioned below was mixed, kneaded, pulverized, classified, and two types of colored particles having an average particle diameter of 8.5 $\mu$m were obtained.

Furthermore, a yellow toner and a magenta toner were prepared by mixing 100 parts of each colored particles prepared as described above, 1.0 part of fine silica particles (particle diameter 12 nm; degree of hydrophobicity 60) in a Henschel mixer.

Yellow C. I. Solvent Yellow 93 6 parts

Magenta C. I. Pigment Red 122 4 parts

Preparation of the Carrier

A resin-coated carrier was prepared by coating fine particles (0.35 weight percent) of a styrene/butylmethacrylate copolymer composed of a ratio of 8/2 and a silicone resin (0.15 weight percent) onto Cu-Zn-Fe ferrite particles.

Preparation of the Developer

The developer employed for practical image formation was prepared by mixing the above-mentioned carrier and each of the toners for 20 minutes employing a V-type mixer so that the toner concentration reached 7 weight percent.

Apparatus and Conditions Employed for Evaluation

In the present Example, evaluation on practical image formation was carried out employing, as an image-forming apparatus, a commercially available full-color digital electrophotographic copier ("preter" 550 manufactured by Ricoh Co., Ltd.). The schematic view of the apparatus is the same as shown in FIG. 1.

Evaluation Items and Methods

Hue variation and transparency

According to the above-mentioned image-forming method, a reflection-type image (an image on a sheet of paper) and a transmission-type image (an image on an OHT) were prepared on a paper sheet and an OHT, respectively, employing a developer comprising the yellow toner of the present invention, and were evaluated according to the methods mentioned below. Further, for the evaluation, the amount of the adhered toner was adjusted to be within the range of 0.7±0.05 mg/cm$^2$.

Hue Variation

Difference in hue between images on the paper sheet and OHT was measured and compared employing a Macbeth CE-7000 with a light source of ASTM-D65 2°.

Transparency

Spectral transmittance of an image comprising no toner was measured employing an "Automatic Spectrophotometer Type 330" manufactured by Hitachi, Ltd. and the spectral transmittance at 570 nm was obtained and was designated as the scale for the toner transparency.

Secondary Chroma

Employing the yellow developer and the above-mentioned magenta developer, after development and transfer were repeated in the order of yellow and then magenta, fixing was carried out. The secondary color (red) image formed on the paper sheet was evaluated according to the method mentioned below. Further, the evaluation was carried out for a range of adhesion of each toner of 0.4±0.05 mg/cm$^2$.

Secondary Chroma

The chroma of the image was measured employing a Macbeth CE-7000, at a light source of ASTM-D65 2°.

Example 2

A developer was prepared in the same manner as in Example 1, except that as a yellow colorant, C. I. Solvent Yellow 162 was employed and was evaluated according to the same method.

Comparative Example

A developer was prepared in the same manner as in Example, except that as a yellow colorant, C. I. Pigment Yellow 17 was employed and was evaluated according to the same method.

Evaluation Results

The results are shown in Table 1 below.

TABLE 1

| | Colorant | Hue Variation of OHT Image | Transparency of OHT Image (%) | Chroma of Secondary Color (red) |
|---|---|---|---|---|
| Example 1 | S.Y. 93 | +0.5 | 72.0 | 71 |
| Example 2 | S.Y. 162 | +0.3 | 70.0 | 75 |
| Comparative Example | P.Y. 17 | −2.8 | 60.5 | 62 |

Employing the colorant of the present invention enables of obtaining the bright yellow OHT image which results in minimum variation in hue and minimum decrease in transparency, and furthermore, enables of obtaining the secondary color image having high chroma. On the other hand, employing the colorant in Comparative Example results in the dark reddish OHT image and the secondary color image having low chroma.

In an image-forming method, in which according to the present invention, a latent image is formed on a latent image carrying body; the resulting latent image is developed by a developer contained in a developer containing device; a plurality of image-forming devices provided with a development means developing a toner image are arranged along a conveyance belt; by passing a recording material through the above-mentioned image-forming device while conveying the recording material with the above-mentioned conveyance belt, an image is formed, a method forming an image excellent in color reproduction and transparency of the OHT image is provided by raising the chroma, in the superimposed images, through preventing shielding of the lower layer while improving the tone transparency of the upper layer.

Example 3

Preparation of the Toner

A mixture consisting of 100 parts of a polyester resin, each of colorants mentioned below, and 3 parts of polypropylene was mixed, kneaded, pulverized, and classified to obtain two types of colored particles having an average diameter of 8.5 $\mu$m.

Furthermore, 100 parts of the above-mentioned colored particles and fine silica particles (particle diameter of 12 nm; hydrophobicity of 60) were mixed employing a Henschel mixer and yellow and magenta toners were prepared.

Yellow C. I. Solvent Yellow 93 6 parts

Magenta C. I. Pigment Red 122 4 parts

Preparation of the Carrier

Into a high speed stirring-type mixer, are put 40 g of fine particles of a styrene/methylmethacrylate copolymer composed of a ratio of 4/6 and 1,960 g of Cu-Zn ferrite particles with a specific gravity of 5.0 and a weight average diameter of 45 $\mu$m, exhibiting a saturation magnetization of 60 emu/g when external magnetization of 1,000 oersted is applied. The resultant mixer was mixed at a mixture's temperature of 30° C. for 15 minutes; thereafter, the mixture was subjected to repeated mechanical impact for 30 minutes, while being kept at a mixture's temperature of 105° C., and then cooled to obtain a resin-coated carrier.

Preparation of the Developer

A mixture consisting of 209.3 g of the above-mentioned carrier and 20.7 g of each toner was mixed for 20 minutes employing a V-type mixer to obtain a developer for practical image-making tests.

Apparatus and Conditions Employed for Evaluation

In the present Example, evaluation on the practical image formation was carried out employing a commercially available digital full color electrophotographic copier (Color Laser Copier 550 manufactured by Canon Inc.) as an image-forming apparatus. The schematic view of the apparatus is similar to that shown in FIG. 2.

Namely, as a latent image-carrying body, a photoreceptor 21 composed of a negatively charged OPC is provided; around the photoreceptor 21, are arranged a primary charging device 23 composed of a roller-shaped electrode, a rotary-type development apparatus 24 containing a plurality of development devices, transfer device 210A, and a cleaning device 226. As the charging device 23, are herein employed a device, for example, prepared by coating, on an electrically conductive elastic layer such as EPDM, a urethane rubber layer and a nylon-based surface layer and by adjusting the total resistance to a range from about $10^5$ to about $10^7$ Ω.

In order to charge the photoreceptor 21 employing a charging device 23, direct current bias voltage or the voltage superimposed on the alternative current is applied to the charging device 23. The photoreceptor 21 is herein charged uniformly to about −700 V employing the bias voltage formed by superimposing a direct current −720 V on an alternative current 1,800 $V_{p\text{-}p}$ (p-p is a voltage between peaks).

An exposure device in FIG. 2 forms scanning exposure light 216 employing a laser diode 211, a polygon mirror 213, etc., and the exposure light scans on a photosensitive drum 21 in the main scanning direction. At that time, the surface electric potential of the part subjected to the exposure decreased to about −100 V, and this decreased area is subjected to reversal development employing a negatively charged toner.

On the other hand, the toner image after development is transferred onto a recording material S previously sustained on the transfer drum 210 via the transfer drum at the transfer position. At the time, the transfer drum 210 was employed which had the constitution such that on an electrically conductive substrate 210*a* such as aluminum, etc., an electrically conductive elastic layer 210*b* composed of a foamed EPDM rubber layer with a thickness of 5 mm, a hardness of 80 degree (measured by Asker F), and a volume resistivity of $10^6$ Ωcm, and furthermore, on the elastic layer 10*b*, a urethane-made dielectric high-resistance layer 210*c* with a volume resistivity of $10^{14}$ to $10^{15}$ Ωcm and a thickness of 40 $\mu$m was coated. And the photoreceptor 21 and the transfer drum 210 were brought into contact employing a hitting section 210*d* which was an insulating flange provided at both the ends of the transfer drum, and the invasion of the electrically conductive elastic layer 210*b* into the photoreceptor 21 was set at about 0.3 mm and the contact pressure at the nip was always kept to be constant. Furthermore, during transfer, to the substrate 210*a*, the transfer voltage, $V_T$ was set so that the voltage for a first color was +750 V and the voltage for a second color and the following color was successively increased by 25 V.

Evaluation Items and Evaluation Methods

According to the above-mentioned image-forming method, a reflection-type image (an image on a sheet of paper) and a transmission-type image (an image on an OHT) were prepared on a sheet of paper and an OHT, respectively, employing the developer comprising the yellow toner of the present invention, and were evaluated according to the methods mentioned below. Further, for the evaluation, the amount of the adhered toner was adjusted to the range of 0.7±0.05 mg/cm$^2$.

Hue Variation

Difference in hue between images on the sheet of paper and the OHT was measured and compared employing a Macbeth CE-7000 at a light source of ASTM-D65 2°.

Transparency

Spectral transmittance of an image comprising no toner was measured employing an "Automatic Spectrophotometer Type 330" manufactured by Hitachi, Ltd. and the spectral transmittance at 570 nm was obtained and was designated as the scale for the toner transparency.

Secondary Chroma

Employing the yellow developer and the above-mentioned magenta developer, after development and transfer were repeated in the order of yellow and then magenta, fixing was carried out. The secondary color (red) image formed on a sheet of paper was evaluated according to the method mentioned below. Further, the evaluation was carried out for the range of adhesion of each toner of 0.4±0.05 mg/cm.

Secondary Chroma

The chroma of the image was measured employing a Macbeth CE-7000 at a light source of ASTM-D65 2°.

Example 4

A developer was prepared in the same manner as in Example 1, except that as a yellow colorant, C. I. Solvent Yellow 162 was employed, and was evaluated according to the same methods.

Comparative Example

A developer was prepared in the same manner as in Example 1, except that as a yellow colorant, C. I. Pigment Yellow 17 was employed, and was evaluated according to the same methods.

(Evaluation Results)

The evaluation results are as show in the Table below.

TABLE 2

| | Colorant | Hue Variation of OHT Image | Transparency of OHT Image (%) | Chroma of Secondary Color (red) |
|---|---|---|---|---|
| Example 1 | S.Y. 93 | +0.5 | 72.0 | 71 |
| Example 2 | S.Y. 162 | +0.3 | 70.0 | 75 |
| Cornparative Example | P.Y. 17 | −2.8 | 60.5 | 62 |

Employing the colorant of the present invention enables of obtaining the bright yellow OHT image which results in minimum variation in hue and minimum decrease in transparency, and furthermore, enables of obtaining a secondary color image having high chroma. On the other hand, employing the colorant in Comparative Example results in the dark reddish OHT image and the secondary color image having low chroma.

In an image-forming method, in which a latent image formed on a latent image carrying body utilizing a charge is visualized employing toners comprising a plurality of different color colorants, by employing an image-forming method which is characterized in that the member which is in pressure contact with the latent image-carrying body exists in at least one of a charging process, a transfer process, and a cleaning process, and at least one of the above-mentioned colorants is either C. I. Solvent Yellow 93 or C. I. Solvent Yellow 162, in superimposed images, the present invention can provide an image which is excellent in color reproduction and transparency of an OHT image and further exhibits improved secondary color chroma by improving the transparency of the toner in the upper layer while increasing the chroma by preventing shielding of the lower layer.

We claim:

1. An image-forming method in which a plurality of colored toner images, different in color, are successively transferred onto a recording material wherein the transferred images are simultaneously subjected to one time fixing, and one of the toners comprises a binder and C. I. Solvent Yellow 93 or C. I. Solvent Yellow 162, both which are yellow colorants.

2. The image-forming method of claim 1, wherein C. I. Solvent Yellow 93 and C. I. Solvent Yellow 162 are dissolved in a resin under a molecular state or are dispersed forming particles having particle size of 0.1 μm or less.

3. The image-forming method of claim 1, wherein amount of the C. I. Solvent Yellow 93 or the C. I. Solvent Yellow 162 is between 0.01 and 15 weight parts of the binder resin of the toner.

4. The image-forming method of claim 3, wherein amount of the C. I. Solvent Yellow 93 or the C. I. Solvent Yellow 162 is between 1.0 and 10 weight parts of the binder resin.

5. The image-forming method of claim 1, wherein the binder resin is styrene resin, acrylic resin, styrene-acrylic resin, polyester resin or epoxy resin.

6. The image-forming method of claim 1, wherein the toner contains release agent selected from a group consisting of low molecular weight polypropylene, low molecular weight polyethylene, ethylene-propylene copolymers, microcrystalline wax, carnauba wax and paraffin wax.

7. The image-forming method of claim 1, wherein the toner comprises fine inorganic particle.

8. The image-forming method of claim 7, wherein the fine inorganic particle is fine silica particle or fine titania particle.

9. The image-forming method of claim 1, wherein an image-forming method is employed in which an image-forming section (image-forming device) of four separate color developers is provided; in each separate image-forming section, a visible image of each color is formed on a photosensitive drum; the visible images are successively transferred to a recording material and are simultaneously fixed to obtain a full color image.

10. The image-forming method of claim 1, wherein an image-forming method comprises developing a latent image for first color image formed on a latent image carrying body by a development device comprising a first color toner, transferring the resulting image onto a recording material carried by a transfer drum, repeating the development and the transferring for forming different color images successively on the recording material, separating the recording material carrying the formed color toner images from the transfer drum, and fixing the color toner images.

* * * * *